United States Patent [19]

Yui et al.

[11] Patent Number: 4,662,109

[45] Date of Patent: May 5, 1987

[54] SLIDING DOOR LOCK ARRANGEMENT

[75] Inventors: Yasuo Yui; Tatsuo Minami, both of Isehara; Kazunori Kawamo, Atsugi, all of Japan

[73] Assignee: Nissan Shatai Company, Limited, Kanagawa, Japan

[21] Appl. No.: 700,278

[22] Filed: Feb. 11, 1985

[30] Foreign Application Priority Data

Dec. 28, 1984 [JP] Japan ..... 59-281137
Dec. 28, 1984 [JP] Japan ..... 59-281138

[51] Int. Cl.[4] ..... E05D 15/10
[52] U.S. Cl. ..... 49/214; 49/215
[58] Field of Search ..... 49/214, 215, 213, 216, 49/449

[56] References Cited

U.S. PATENT DOCUMENTS 3,100,667 8/1963 Schwenk ..... 49/214
3,605,338 9/1971 Grossbach ..... 49/216 X
3,903,648 9/1975 Maneck ..... 49/215
4,152,872 5/1979 Tanizaki et al. ..... 49/214
4,530,184 7/1985 Chikaraishi et al. ..... 49/213

FOREIGN PATENT DOCUMENTS 59-170012 11/1984 Japan .
2049774 12/1980 United Kingdom ..... 49/215

*Primary Examiner*—Philip C. Kannan
*Attorney, Agent, or Firm*—Bachman & LaPointe

[57] ABSTRACT

A vehicle body has a door opening. A door has a front edge and a rear edge. The door is slidable relative to the vehicle body and is able to close and unblock the door opening. A device serves to releasably lock the door rear edge to the vehicle body when the door is in its closed position. Another device serves to releasably lock the door front edge to the vehicle body when the door is in its closed position.

3 Claims, 15 Drawing Figures

SLIDING DOOR LOCK ARRANGEMENT

BACKGROUND OF THE INVENTION

1. Field of the Invention

This invention relates to a lock arrangement for a vehicle sliding door.

2. Description of the Prior Art

Some vehicles have sliding doors. The sliding mechanism includes guide rails attached to the vehicle body, and rollers supported on the door. The rollers are guided by the rails so that the door can slide relative to the vehicle body.

Generally, only one lock is provided to lock the door to the vehicle body when the door is in its closed position. The location of this lock is a point of the rear of the door. When the door is in its closed position, the rear of the door is supported on the vehicle body by means of the lock and the front of the door is supported on the vehicle body by means of the engagement between the guide rails and the rollers. The support by the lock is adequately firm, while the support by the engagement between the guide rails and the rollers is relatively weak. Accordingly, it is necessary to increase the thicknesses or the sizes of the door and other parts in order to obtain reliable support of the door.

SUMMARY OF THE INVENTION

It is an object of this invention to provide a sliding door lock arrangement which enables firm support of the door without increasing the thicknesses or the sizes of the door and other parts.

An arrangement of this invention is applied to a vehicle having a body formed with a door opening. In this arrangement, the door has a front edge and a rear edge. A door slidable relative to the vehicle body closes and unblocks the door opening. A device releasably locks the door rear edge to the vehicle body when the door is in its closed position. Another device releasably locks the door front edge to the vehicle body when the door is in its closed position.

DESCRIPTION OF THE PREFERRED EMBODIMENTS

Figure 1:
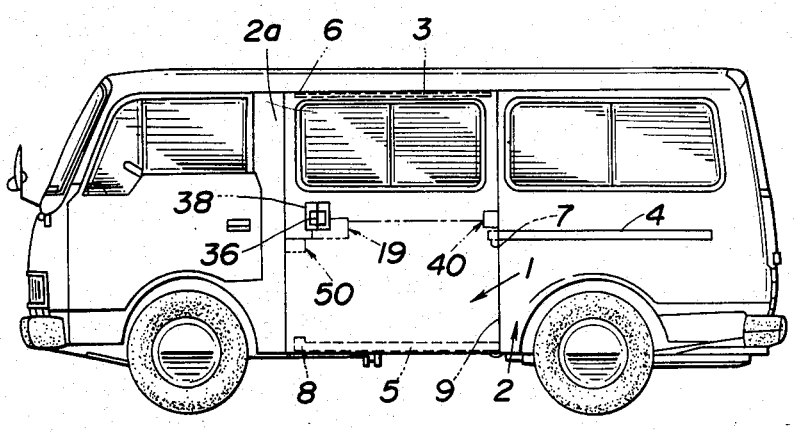
FIG. 1 is a side view of an automotive vehicle provided with a sliding door lock arrangement according to a first embodiment of this invention.
Figure 2:
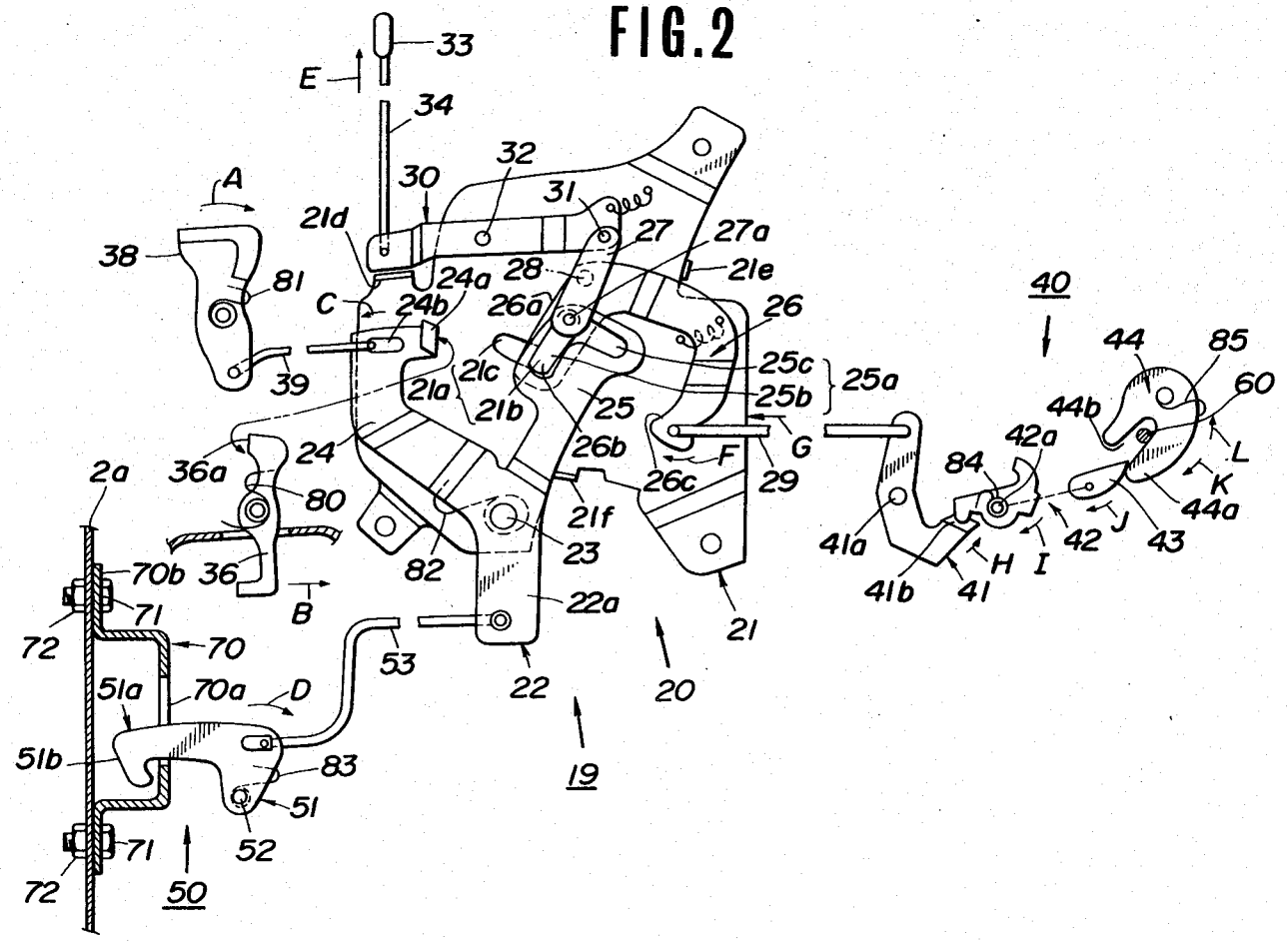
FIG. 2 is a diagrammatic view of the sliding door lock arrangement of FIG. 1.

FIGS. 1 and 2 show a sliding door lock arrangement according to a first embodiment of this invention. As shown in FIG. 1, a one-box-type or vantype automotive vehicle has a sliding door 1. This sliding door 1 is supported on a side of the vehicle body 2 and is slidable longitudinally with respect to the vehicle body 2 to close and unlock a door opening 9 formed in the vehicle body 2.

Upper, waist, and lower guide rails 3, 4, and 5 extending longitudinally with respect to the vehicle body 2 are fixed to the side of the vehicle body 2. Upper and lower rollers 6 and 8 rotatably supported on the top and the bottom of a front edge of the sliding door 1 slidably engage the upper and the lower guide rails 3 and 5 respectively. Waist rollers 7 rotably supported on the center of a rear edge of the sliding door 1 slidably engage the waist guide rail 4. As an appropriate longitudinal force is applied to the sliding door 1, the rollers 6, 7, and 8 are guided by the rails 3, 4, and 5 and the door 1 is moved longitudinally. In the case of FIG. 1, the sliding door 1 is in its closed position. As the door 1 is moved rearwards from its closed position, the door opening 9 is unblocked.

As shown in FIGS. 1 and 2, an arrangement for releasably locking the sliding door 1 to the vehicle body 2 when the door 1 is in its closed position, includes a door lock operation unit 19, a rear lock mechanism 40, a front lock mechanism 50, a rear striker 60, and a front striker 70. The operation unit 19 has an outside handle 36 movably provided on and extending outwardly from the door outer surface, an inside handle 38 movably provided on an inner surface of the door 1 opposing the vehicle interior, and an operation mechanism 20. The lock mechanisms 40 and 50 are mounted on the door 1. The strikers 60 and 70 are fixed to the vehicle body 2. When the lock mechanisms 40 and 50 firmly engage the strikers 60 and 70 respectively, the door 1 is locked to the vehicle body 2.

Under conditions where the door 1 has been locked, as the outside handle 36 or the inside handle 38 is actuated to drive the operation mechanism 20, the lock mechanisms 40 and 50 move out of firm engagement with the strikers 60 and 70. Thus, the door 1 is unlocked. In cases where the lock is released, the application of an appropriate rearwardly-directed force allows the door 1 to slide rearwards and to unblock the door opening 9.

When the door 1 is moved frontwards into its closed position, the lock mechanisms 40 and 50 automatically firmly engage the strikers 60 and 70, thereby locking the door 1 without driving the door lock operation unit 19.

The details of the operation mechanism 20 will follow. A remote control base plate 21 is fixedly disposed within the sliding door 1. An approximately Y-shaped remote control lever 22 is rotatably connected to the base plate 21 by means of a pivot 23 extending through a center of the lever 22. This lever 22 has a first arm 24 extending leftwards and upwards as viewed in FIG. 2. The tip of the first arm 24 is formed with an engagement section 24*a* and an elongated hole 24*b* extending longitudinally with respect to the vehicle body 2. This engagement section 24*a* abuts an engagement end 36*a* of the outside handle 36 (shown diagrammatically) so that actuation of the handle 36 allows the remote control lever 22 to rotate counterclockwise as viewed in FIG. 2. A rod 39 connected to the inside handle 38 has an end extending into the elongated hole 24*b* and thereby engaging the first arm 24. Actuation of the handle 38 allows the remote control lever 22 to rotate counterclockwise as viewed in FIG. 2. The lever 22 has a second arm 25 extending rightwards and upwards as viewed in FIG. 2. The tip of the second arm 25 has a guide hole 25*a*, which includes an enabling elongated segment 25*b* and a disabling segment 25*c* extending perpendicular to and communicating with the former segment 25*b*.

The second arm 25 is associated with a release lever 26, a connecting plate 27, and the base plate 21. Specifically, a portion of the release lever 26 extends between the second arm 25 and the base plate 21. The release lever 26 is approximately U-shaped and is rotatably connected to the base plate 21 by means of a pivot 28 extending through a right-hand corner of the lever 26 as viewed in FIG. 2. The release lever 26 has a leg 26*a* formed with an elongated hole 26*b*. This hole 26*b* is of approximately the same dimensions as those of the enabling hole 25*b* in the second arm 25 and aligns with the hole 25*b*. The release lever 26 has another leg 26*c* opposing the former leg 26*a*. One end of a rod 29 is connected to the leg 26*c* and the other end of the rod 29 is connected to the rear lock mechanism 40 so that the rod 29 interconnects the leg 26*c* and the mechanism 40. The base plate 21 has an elongated guide hole 21*a* related to the elongated hole 26*b* of the release lever 26. This hole 21*a* includes a guiding segment 21*b* and a moving segment 21*c* extending perpendicular to and communicating with the former segment 21*b*. The guiding segment 21*b* aligns with the elongated hole 26*b* and is of approximately the same dimensions as those of the hole 26*b*. The connecting plate 27 has a free end from which a pin 27*a* projects. This pin 27*a* extends through the guiding hole 21*a* of the base plate 21, the guide hole 25*a* of the second arm 25, and the elongated hole 26*b* of the release lever 26. The connecting plate 27 has a base which is rotatably connected to one end of a knob lever 30 by means of a pivot 31. A central portion of the knob lever 30 is rotatably connected to the base plate 21 by means of a pivot 32. The other end of the knob lever 30 is connected to a knob 33 via a rod 34. The base plate 21 is provided with fixed stoppers 21*d*, 21*e*, and 21*f*. The stopper 21*d* can engage the knob lever 30 to limit displacement of the lever 30. The stopper 21*e* can engage the release lever 26 to limit displacement of the lever 26. The stopper 21*f* can engage the remote control lever 22 to limit displacement of the lever 22.

The rear lock mechanism 40 is located essentially at a center of the rear edge of the sliding door 1 and is connected to the door lock operation unit 19. Specifically, the rear lock mechanism 40 includes an unlocking lever 41, a first open lever 42, a second open lever 43, and a rear latch or lock member 44. The unlocking lever 41 is rotatably connected by means of a pivot 41*a* to a lock base plate (not shown) fixed to an inner panel (not shown) of the sliding door 1. One end of a rod 29 is connected to the release lever 26. The other end of the rod 29 is connected to one end of the unlocking lever 41. The other end of the unlocking lever 41 is formed with an engagement section 41*b* abutting one end of the first open lever 42 rotatably connected to the lock base plate by means of a pivot 42*a*. Both of the first and second open levers 42 and 43 are fixedly mounted on the pivot 42*a* so that the second open lever 43 rotates with rotation of the first open lever 42. It should be noted that FIG. 2 is a diagrammatic view. One end of the second open lever 43 disconnectably engage an engagement section 44*a* of the rear lock member 44. This lock member 44 is pivotally connected to the lock base plate by means of a pin (not denoted). When the lock member 44 and the second open lever 43 are in engagement with each other, the lock member 44 firmly engages the rear striker 60 fixed to a section of the vehicle body 2 defining the rear edge of the door opening 9. When the lock member 44 and the second open lever 43 are out of engagement, the lock member 44 can disengage from the rear striker 60. The rear lock member 44 has an engagement cut 44*b*, within which the rear striker 60 resides when the sliding door 1 is in its closed position.

The front lock mechanism 50 is provided on the front edge of the sliding door 1. Specifically, the front lock mechanism 50 includes a front latch or lock member 51 rotatably supported within the sliding door 1 via a pivot 52. The front lock member 51 is connected by means of a rod 53 to a downwardly-projecting third arm 22*a* of the remote control lever 22. One end of the front lock member 51 is formed with a hook 51*a*. The front lock member 51 disconnectably engages the front striker 70 fixed to a section of the vehicle body 2 defining the front edge of the door opening 9. The front striker 70 is of a U-shaped section and has flanged edges 70*b*. A central portion of the front striker 70 has a hole 70*a*. The flanges 70*b* are fixed to a center pillar 2*a* of the vehicle body 2 by means of bolts 71 and nuts 72. When the hook 51*a* moves into the front striker 70 through the hole 70*a* and engages a portion of the striker 70 defining the hole 70*a*, the front lock mechanism 50 is activated. When the hook 51*a* disengages from the striker 70 and moves out of the striker 70 through the hole 70*a*, the front lock mechanism 50 is completely at rest.

The sliding door lock arrangement operates as follows. Under conditions where the sliding door 1 is in its closed position and the knob 33 is in its lower position as shown in FIG. 2, when the outside handle 36 is moved in the direction B against the force of a spring 80 urging the handle 36 or the inside handle 38 is moved in the direction A against the force of a spring 81 urging the handle 38, the first arm 24 of the remote control lever 22 is pulled in the direction C and the remote control lever 22 is rotated counterclockwise against the force of a spring 82 urging the lever 22. Since the pin 27*a* on the connecting plate 27 is positioned in the disabling hole 25*c* of the remote control lever second arm 25, rotation of the remote control lever 22 does not cause any movement of the release lever 26 so that the rear lock mechanism 40 remains in its locked or active position.

In respect of the front lock mechanism 50, the rotation of the remote control lever 22 enables movement of the rod 53, allowing the front lock member 51 to rotate in the direction D against the force of a spring 83 urging the member 51. As long as the sliding door 1 is in its closed position, the hook 51*a* of the front lock member 51 remains within the front striker 70. It should be noted that when the rear lock mechanism 40 is in its locked or active position, the sliding door 1 remains held in its closed position. When the operation force on the outside handle 36 or on the inside handle 38 is released, the front lock member 51 returns into engagement with the front striker 70. In this way, as long as the knob 33 is in its lower position, it is impossible to unlock the sliding door 1.

In cases where the sliding door 1 is in its closed position and the lock mechanisms 40 and 50 are in their locked or active positions, a component of load or force applied to the door 1 in the transverse direction from the interior to the exterior of the vehicle which acts on a front area of the door 1 is borne mainly by the engagement between the front lock mechanism 50 and the front striker 70. As a result, the guide rails 3 and 5, and the upper and lower rollers 6 and 8 engaging these rails are subjected to relatively weak forces. Accordingly, it is unnecessary to increase the thicknesses of the sliding door 1, and the guide rails 3 and 5. This allows the weight of the vehicle to decrease.

Under conditions where the sliding door 1 is in its closed position, when the knob 33 is pulled up to its upper position in the direction E, the knob lever 30 is rotated and the connecting plate 27 is moved downwards. At the same time, the pin 27*a* is guided downwards along the guiding segment 21*b* of the remote control base plate guide hole 21*a*, the elongated hole 26*b* of the release lever 26, and the enabling segment 25*b* of the second arm guide hole 25*a* to lower ends of these holes. In this case, when the outside handle 36 or the inside handle 38 is actuated and thus the remote control lever 22 is rotated, the second arm 25 forces the pin 27*a* on the connecting plate 27, thereby moving the leg 26*a* of the release lever 26. During this period, the pin 27*a* is guided along the moving segment 21*c* of the remote control base plate guide hole 21*a*. The movement of the leg 26*a* rotates the whole of the release lever 26 in the direction F, pulling the rod 29 in the direction G.

The movement of the rod 29 rotates the unlocking lever 41 of the rear lock mechanism 40 in the direction H so that the engagement section 41*b* of the lever 41 forces the first open lever 42 to pivot in the direction I against the force of a spring 84 urging the lever 42. At the same time, the second open lever 43 rotates in the direction J and moves out of firm engagement with the rear lock member 44. In this case, the rear lock member 44 can be rotated in the direction K by the force of a spring 85 urging the member 44, that is, in the direction toward a position where the member 44 is able to separate from the rear striker 60. It should be noted that when the sliding door 1 is in its closed position, the rear lock member 44 and the rear striker 60 remain in contact with one another as shown in FIG. 2.

In respect of the front lock mechanism 50, the rotation of the remote control lever 22 allows the rod 53 to move and also the front lock member 51 to pivot in the direction D. The rotation of the lock member 51 enables its hook 51*a* to disengage from the section of the front striker 70 defining the hole 70*a*.

In the case where the front lock mechanism 50 and the rear lock mechanism 40 are in the positions described immediately above, as the sliding door 1 is moved rearwards from its closed position along the guide rails 3, 4, and 5, the rear lock member 44 moves out of the engagement cut 44*b* of the rear striker 60 and separates from the striker 60. At the same time, the hook 51*a* of the front lock member 51 moves out of the front striker 70 through the hole 70*a* and separates from the striker 70.

As the sliding door 1 is moved frontwards into its closed position, the rear striker 60 enter the engagement cut 44*b* of the rear lock member 44 of the rear lock mechanism 40 and forces the member 44 to pivot in the direction L. At the same time, the rear lock member 44 forces the second open lever 43 to rotate in the direction J and slides on the lever 43 so that the engagement section 44*a* passes over the tip of the lever 43. After the engagement section 44*a* passed the tip of the lever 43, the second open lever 43 and the rear lock member 44 move into firm engagement with each other so that the rear lock member 44 is locked to the rear striker 60 as shown in FIG. 2.

In accordance with the movement of the sliding door 1 into its closed position, an oblique sliding surface 51*b* on the hook 51*a* of the front lock member 51 of the front lock mechanism 50 slides on the section of the front striker 70 defining the hole 70*a* and also rotates in the direction D, moving into the striker 70 through the hole 70*a* and firmly engaging the section of the striker 70 defining the hole 70*a*. In this way, the front lock member 51 is locked to the front striker 70.

In the embodiment of FIGS. 1 and 2, the front lock mechanism may be in other locations within the front edge of the sliding door.

Figure 3:
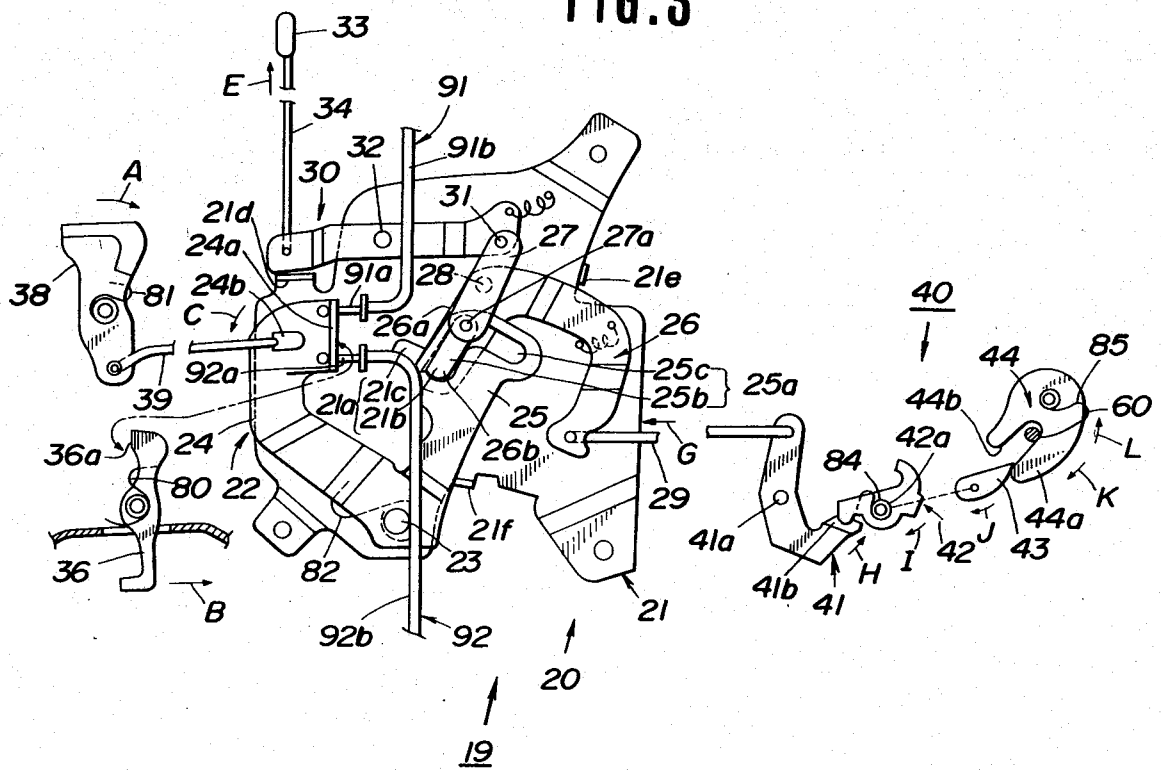
FIG. 3 is a diagrammatic view of a sliding door lock arrangement according to a second embodiment of this invention.
Figure 4:
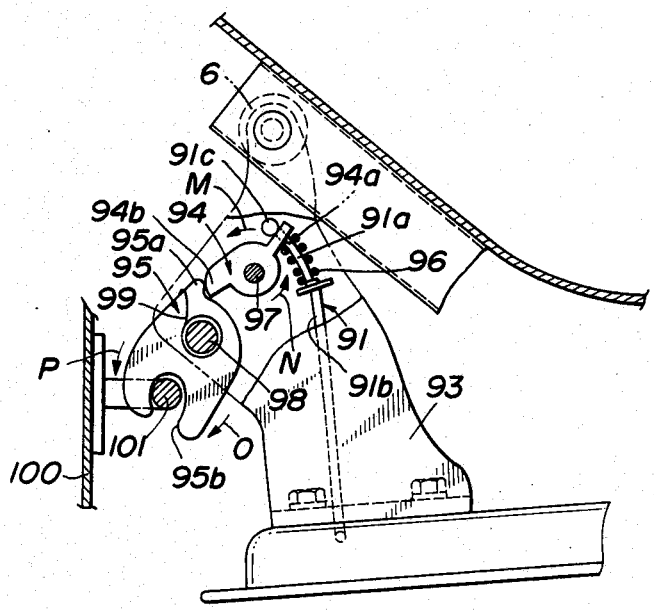
FIG. 4 is a plan view, partly in section, of the front lock mechanism of FIG. 3.

FIGS. 3 and 4 show a second embodiment of this invention which includes a pair of front lock mechanisms 90 each different from that of the embodiment of FIGS. 1 and 2. In other designs, this second embodiment is similar to the embodiment of FIGS. 1 and 2. The second embodiment is applied to a sliding door of an automotive vehicle having no center pillar.

The front lock mechanisms 90 are positioned at the top and the bottom of the front edge of the sliding door 1 respectively. Cables 91 and 92 include wires 91*a* and 92*a* having ends fixed to the engagement section 24*a* of the remote control lever first arm 24. The cable 91 extends upwards to a point near an upper roller bracket 93 (see FIG. 4) fixed to the sliding door 1. The other cable 92 extends downwards to a point near a lower roller bracket (not shown) fixed to the sliding door 1.

The details of the front lock mechanism 90 at the top of the front edge of the sliding door 1 will follow. As shown in FIG. 4, the cable 91 is connected to an open lever 94 supported on the upper roller bracket 93. The cable 91 includes a tube 91*b* through which the wire 91*a* slidably extends. The tube 91*b* has an end fixed to the upper roller bracket 93. The wire 91*a* projects from the tube 91*b* and passes through a hole 94*a* in the open lever 94. An engagement member 91*c* mounted on the end of the wire 91*a* abuts the open lever 94 so that the wire 91*a* is connected to the lever 94. A spring 96 is seated between the open lever 94 and the tube 91*b*. The open lever 94 is rotatably connected to the upper roller bracket 93 by means of a pivot 97. The open lever 94 has an engagement end 94*b* releasably engaging an engagement projection 95*a* formed on a front lock member or latch 95. A spring 97 urges the open lever 94 counterclockwise as viewed in FIG. 4. The front lock member 95 is rotatably connected to the upper roller bracket 93 by means of a pivot 98. A spring 99 urges the front lock member 95 clockwise as viewed in FIG. 4. The front lock member 95 has an engagement cut 95*b*. A front striker 101 located at the front edge of the door opening 9 is fixed to a roof side rail 100 secured to the vehicle body 2. The front striker 101 is movable into and out of the engagement cut 95*b* to engage with and separate from the front lock member 95.

The front lock mechanism provided at the bottom of the front edge of the door 1 and supported on the lower roller bracket is designed in a manner similar to that of the front lock mechanism 90 located at the top of the door front edge. The door lock operation unit 19 and the rear lock mechanism 40 are similar to those of the embodiment of FIGS. 1 and 2.

In operation, under conditions where the knob 33 is in its lower position as shown in FIG. 3 and the sliding door 1 is in its closed position, when the outside handle 36 or the inside handle 38 is actuated, the remote control lever 22 is rotated in the direction C, thereby pulling the wires 91*a* and 92*a* of the cables 91 and 92. As the wire 91*a* (see FIG. 4) is pulled, the spring 96 is compressed and the open lever 94 is rotated in the direction M, releasing the lock member engagement projection 95*a* from the engagement end 94*b* of the lever 94. As in the embodiment of FIGS. 1 and 2, when the knob 33 is in its lower position, the rear lockmechanism 40 remains in firm engagement with the rear striker 60 and thus the sliding door 1 is stably held in its closed position. As long as the sliding door 1 is in its closed position, the front striker 101 remains within the engagement cut 95*b* of the front lock member 95 and prevents the member 95 from pivoting. In this case, when the operation force is released from the outside handle 36 or the inside handle 38, the open lever 94 is rotated in the direction N and is returned to its active position by the force of the spring 96 as shown in FIG. 4. The front lock mechanism supported on the lower roller bracket operates in the similar way.

Under conditions where the sliding door 1 is in its closed position and the knob 33 is in its upper position, when the outside handle 36 or the inside handle 38 is actuated, the rear lock member 44 of the rear lock mechanism 40 assumes a position in which the member 44 can rotate in the direction K, that is, the member 44 can disengage from the rear striker 60. At this time, the front lock mechanism 90 operates in the same way as described above. Specifically, the front lock member 95 is released from the open lever 94 and assumes a position in which the member 95 can rotate in the direction O, that is, the member 95 can disengage from the front striker 101. In this case, as the sliding door 1 is opened, the rear lock member 44 and the front lock member 95 separate from the rear striker 60 and the front striker 101 respectively.

As the sliding door 1 is moved into its closed position, the rear lock mechanism 40 firmly engages the rear striker 60 as in the embodiment of FIGS. 1 and 2. At the same time, the front lock mechanism 90 firmly engages the front striker 101. Specifically, the front striker 101 forces the front lock member 95 to pivot in the direction P. The engagement projection 95*a* on the front lock member 95 pushes the engagement end 94*b* of the open lever 94, thereby rotating the open lever 94 in the direction M. The rotation of the open lever 94 allows the engagement projection 95*a* to pass over the engagement end 94*b*. After the engagement projection 95*a* passed over the engagement end 94*b*, the front lock mechanism 90 firmly engages the front striker 101 as shown in FIG. 4.

In this locked case, the rear of the sliding door 1 is supported mainly via the rear lock mechanism 40 and the front of the door 1 is supported mainly via the front lock mechanisms 90 on the top and the bottom of the door front edge. Therefore, when a transverse force or load is applied to the sliding door 1, the guide rails 3 and 5, and the upper and lower rollers 6 and 7 engaging these rails 3 and 5 are subjected to relatively weak forces as in the embodiment of FIGS. 1 and 2. In comparison with the conventional supporting structures, the thicknesses of the guide rails 3 and 5 are allowed to decrease. This results in a reduction of the weight of the vehicle. Even in cases where the guide rails 3 and 4 have curved front ends, the top and the bottom of the front edge of the sliding door 1 are stably supported via the front lock mechanisms 90 when the door 1 is locked to the vehicle body 2. These stable supports result in the prevention of unwanted deformation of the sliding door 1. Accordingly, the thickness of the sliding door 1 is allowed to decrease.

Figure 5:
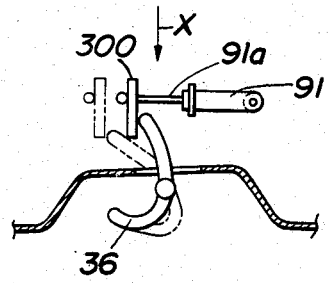
FIG. 5 is a sectional view of a modification of the second embodiment of this invention.
Figure 6:
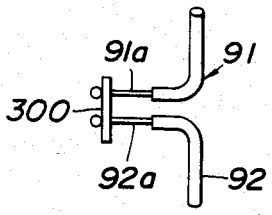
FIG. 6 is a view in the direction of the arrow X in FIG. 5.

FIGS. 5 and 6 show a modification of the embodiment of FIGS. 3 and 4. In this modification, the wires 91*a* and 92*a* of the cables 91 and 92 are connected to a movable plate 300 abutting both of the outside handle 36 and the inside handle 38 (not shown in FIG. 5). Actuation of the outside handle 36 or the inside handle 38 allows the wires 91*a* and 92*a* to be pulled. In other designs, this modification is similar to the embodiment of FIGS. 3 and 4.

FIGS. 7 to 14 show a third embodiment of this invention. This embodiment is applied to a vehicle having no center pillar.

A waist guide rail 103 of the U-shaped cross-section has a front portion curved toward the interior of the vehicle. The waist guide rail 103 is provided on the outer surface of the vehicle body extending rearwards from the door opening 102 formed in the side of the vehicle body. An upper guide rail 104 of a U-shaped cross-section has a front portion curved toward the interior of the vehicle and extends along the upper edge of the door opening 102. A lower guide rail 105 of a U-shaped cross-section has a front portion curved toward the interior of the vehicle and extends along the lower edge of the door opening 102. These guide rails 103, 104, and 105 are fixed to the vehicle body and extend longitudinally with respect to the vehicle.

A central portion of a rear edge of a sliding door 106 slidably engages the waist guide rail 103 via a waist roller supporting mechanism 129A. The top of a front edge of the sliding door 106 slidably engages the upper guide rail 104 via an upper roller supporting mechanism 129B. The bottom of the front edge of the sliding door 106 slidably engages the lower guide rail 105 via a lower roller supporting mechanism 129C.

Each of the supporting mechanisms 129A, 129B, and 129C includes a pair of carriage rollers 124 and a side roller 125. These rollers 124 and 125 are rotatably supported on a roller bracket 126. The roller bracket 126 is connected by a pivot 127 to a door arm 128 in such a manner as to be free to rotate in the horizontal with respect to the vehicle. The door arm 128 is fixed by means of screws 130 to an inner panel of the sliding door 106. The rollers 124 and 125 engage the corresponding guide rail in such a manner that they can slide along the guide rail and can be guided by the guide rail. The carriage rollers 124 mainly bear a horizontal load or force. The side roller 125 bears a vertical load resulting from the weight of the door 106.

As the sliding door 106 is displaced from its closed position toward its fully open position, the door 106 moves outwards and rearwards with respect to the vehicle in accordance with the curved fronts of the guide rails 103, 104, and 105. At this time, rotation of the rollers brackets 126 allow the rollers 124 and 125 to follow the curved surfaces of the guide rails. Then, the sliding door 106 moves rearwards along the outer surface of the vehicle body.

A door lock operation unit 110 disposed within a central portion of the front edge of the sliding door 106 includes an outside handle 111, an inside handle 112, and an operation mechanism 113.

Figure 8:
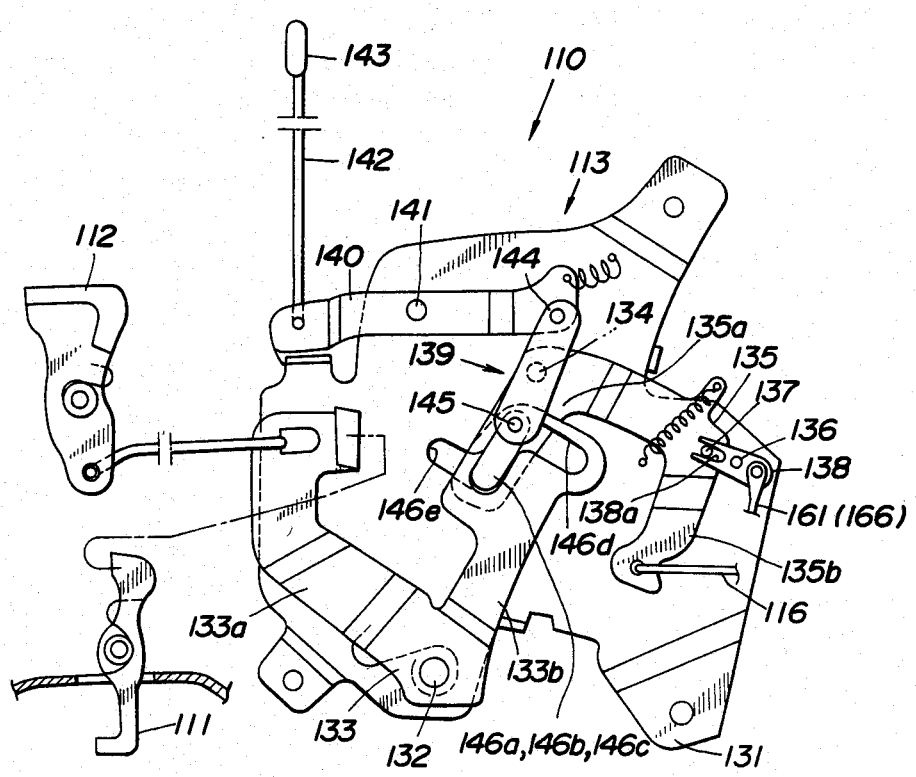
FIG. 8 is a diagrammatic view of the door lock operation unit of FIG. 7.

The details of the operation mechanism 113 will follow. As shown in FIG. 8, a base plate 131 is fixed to the inner panel of the sliding door 106. A remote control lever 133 is rotatably connected to the base plate 131 by means of a pivot 132. The remote control lever 133 is approximately V-shaped and has an input arm 133*a* and an output arm 133*b*. The input arm 133*a* is connected to the outside and inside handles 111 and 112 directly or via a rod so that the remote control lever 133 is actuated via these handles 111 and 112. An approximately U-shaped release lever 135 is rotatably connected to the base plate 131 by means of a pivot 134. The release lever 135 has an input arm 135*a* and an output arm 135*b*. This input arm 135*a* and the output arm 133*b* of the remote control lever 133 overlap each other. A relief lever 138 is rotatably connected to the base plate 131 by means of a pivot 136. One end of the relief lever 138 has an elongated groove 138*a*, in which a pin 137 mounted on and projecting from the output arm 135*b* of the release lever 135 is disposed. In this way, the levers 135 and 138 are connected so that the relief lever 138 pivots with rotation of the release lever 135. The output arm 133*b* of the remote control lever 133 and the input arm 135*a* of the release lever 135 are connected via a safety lock mechanism 139.

The safety lock mechanism 139 operates to prevent unlocking of a rear lock mechanism 114, and front lock mechanisms 152 and 163 due to mis-actuation of the outside handle 111 or the inside handle 112. The safety lock mechanism 139 includes a knob lever 140 and a relief link 144. The knob lever 140 is rotatably connected to the base plate 131 by means of a pivot 141. A knob rod 142 connected to one end of the knob lever 140 has an upper free end on which a knob 143 exposed to the vehicle interior is mounted. The other end of the knob lever 140 is pivotally connected to one end of the relief link 144. A safety lock pin 145 is fixed to the other end of the relief link 144. Portions of the base plate 131, the remote control lever output arm 133*b*, and the release lever input arm 135*a* overlapping each other have aligned elongated holes 146*a*, 146*b*, and 146*c*, respectively, through which the safety lock pin 145 extends. The output arm 133*b* of the remote control lever 133 has a disabling hole 146*d*, which extends perpendicularly from an upper end of the elongated hole 146*b*. The base plate 131 has a moving elongated hole 146*e*, which extends perpendicularly from a lower end of the elongated hole 146*a*.

When the knob 143 is in its lower position, the safety lock pin 145 resides at upper ends of the elongated holes 146*a*, 146*b*, and 146*c*. In this case, as the outside handle 111 or the inside handle 112 is actuated and thus the remote control lever 133 is rotated, the safety lock pin 145 relatively slides in the disabling hole 146*d* so that any motion is not transmitted to the release lever 135.

When the knob 143 is in its upper position, the safety lock pin 145 resides at lower ends of the elongated holes 146*a*, 146*b*, and 146*c*. In this case, as the outside handle 111 or the inside handle 112 is actuated and thus the remote control lever 133 is rotated, the release lever 135 is rotated and the safety lock pin 145 slides in the moving hole 146*e*.

Figure 9:
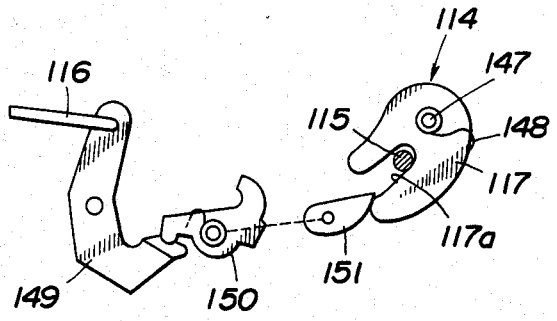
FIG. 9 is a diagrammatic view of the rear lock mechanism of FIG. 7.
Figure 10:
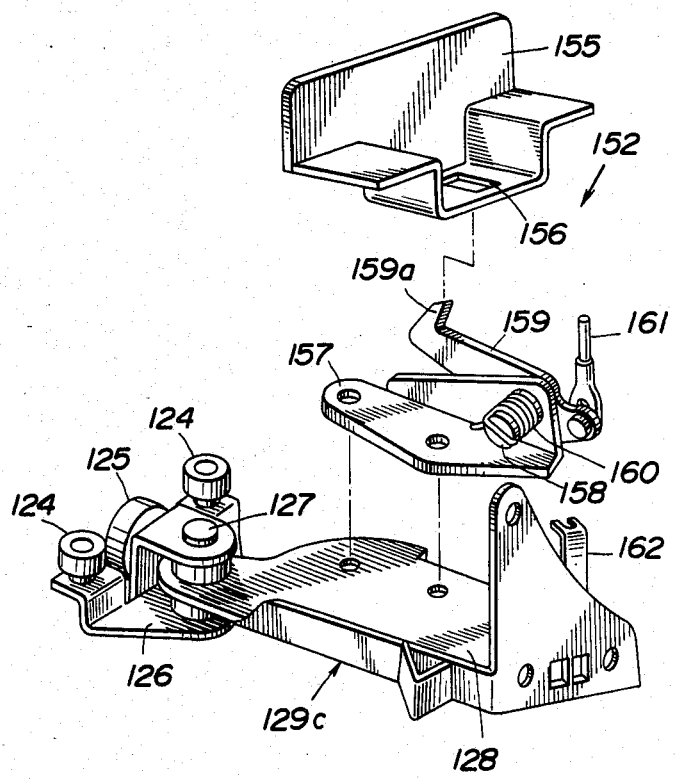
FIG. 10 is an exploded perspective view of the lower roller supporting mechanism and the lower front lock mechanism of FIG. 7.
Figure 11:
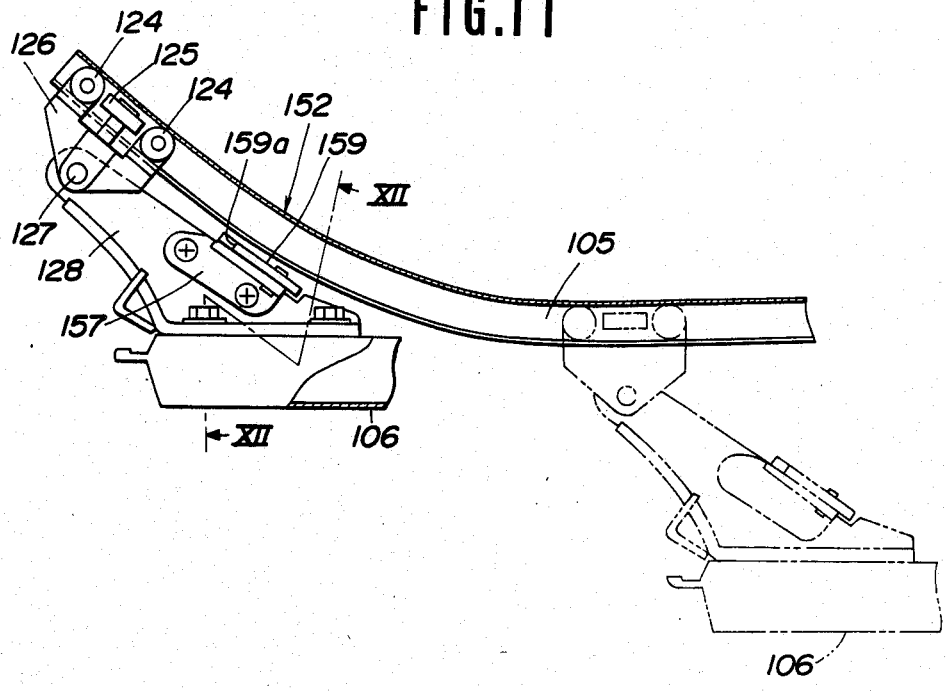
FIG. 11 is a sectional view of the lower front lock mechanism and its surroundings of FIG. 7.
Figure 12:
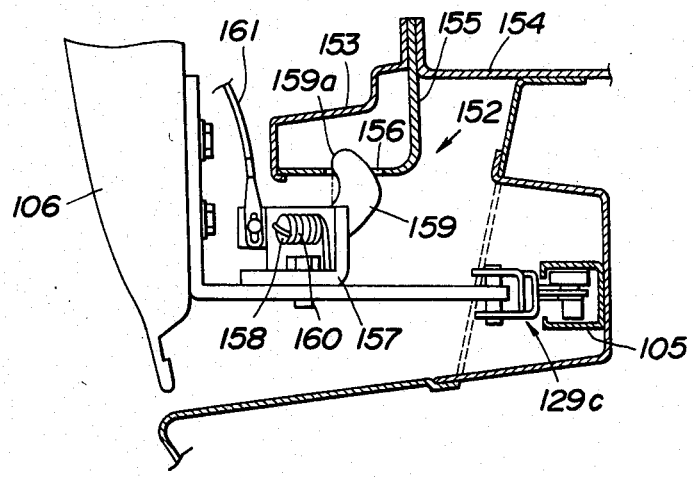
FIG. 12 is a sectional view taken along the line XII—XII of FIG. 11.

As shown in FIG. 9, the rear lock mechanism 114 includes a striker 115 and a lock member or latch 117. The striker 115 is fixed to a point of the vehicle body defining the rear edge of the door opening 102. The latch 117 disconnectably engages the striker 115 and is provided on a point of the rear edge of the sliding door 106. The latch 117 is rotatably connected by means of a pivot 147 to a base plate (not shown) fixed to the inner panel of the sliding door 106. The latch 117 has an engagement groove 117*a*, in which the striker 115 resides when the sliding door 106 is in its closed position as shown in FIG. 9. A spring 148 urges the latch 117. The latch 117 is connected to the output arm 135*b* of the release lever 135 via a rod 116, an unlocking lever 149, a first open lever 150, and a second open lever 151.

Under conditions where the sliding door 106 is in its closed position and the knob 143 is in its lower position, the striker 115 resides in the groove 117*a* and thus engages the latch 117. Under the same conditions, the second open lever 151 firmly engages the latch 117. Accordingly, the latch 117 remains in firm engagement with the striker 115. When the operation mechanism 113 is activated and the release lever 135 is rotated, the second open lever 151 is rotated and thereby releases the latch 117, unlocking the rear lock mechanism 114. In this unlocked situation, as the door 106 is opened, the latch 117 separates from the striker 115.

As shown in FIGS. 7, 10, 11, and 12, a lower front lock mechanism 152 is provided between the front of the lower guide rail 105 and the lower roller supporting mechanism 129C. The details of this lock mechanism 152 will follow.

At a location of the lower edge of the door opening 102, a bracket 155 having a receiving hole 156 is fixed between a vehicle body shell outer 153 and a vehicle body floor panel 154. Another bracket 157 is bolted to the upper surface of the door arm 128 of the lower roller supporting mechanism 129C. A hook 159 is rotatably connected to the bracket 157 by means of a pivot 158. The hook 159 has an engagement end 159*a*. This engagement end 159*a* moves into and out of the receiving hole 156 in accordance with rotation of the hook 159. A spring 160 disposed around the pivot 158 has one end connected to a head of the pivot 158 and the other end connected to the bracket 157. The pivot 158 is free to rotate relative to the bracket 157. The hook 159 is mounted on the pivot 158. Accordingly, the spring 160 urges the hook 159. When the door 106 is closed and locked, the engagement end 159*a* resides in the receiving hole 156 and thus engages the bracket 155.

One end of a wire 161 is pivotally connected to the other end of the hook 159. As shown in FIG. 8, the other end of the wire 161 is connected to a base end of the relief lever 138 of the operation mechanism 113. As the operation mechanism 113 is activated and the release lever 135 is rotated, the relief lever 138 is also rotated and thus the wire 161 is moved. The movement of the wire 161 rotates the hook 159, displacing the engagement end 159*a* out of the receiving hole 156. The wire 161 is slidably covered with a wire tube (not shown) supported by a tube seat 162 fixed to the door arm 128.

Figure 7:
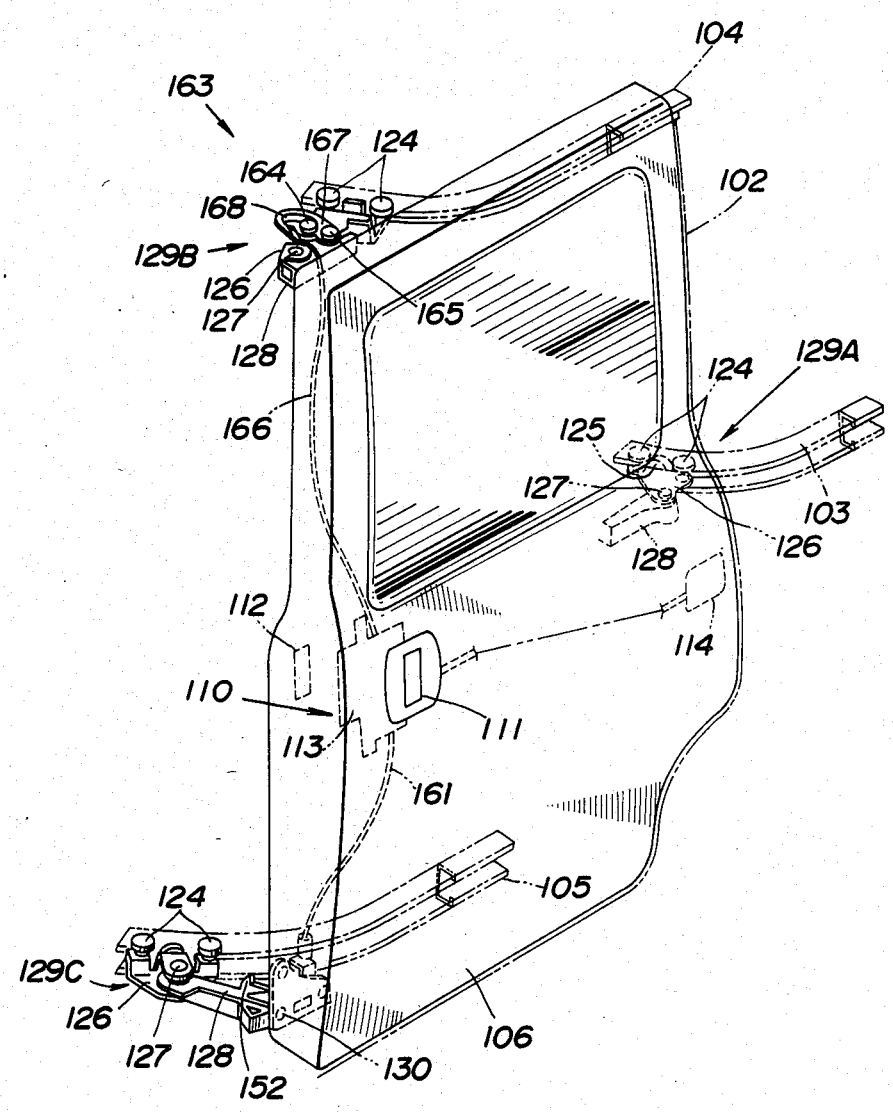
FIG. 7 is a perspective view of a sliding door lock arrangement according to a third embodiment of this invention.
Figure 13:
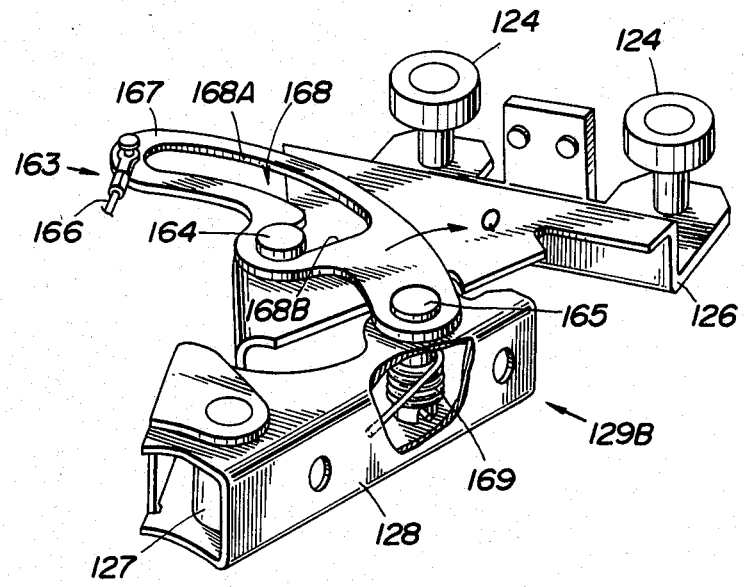
FIG. 13 is a perspective view of the upper front lock mechanism of FIG. 7.
Figure 14:
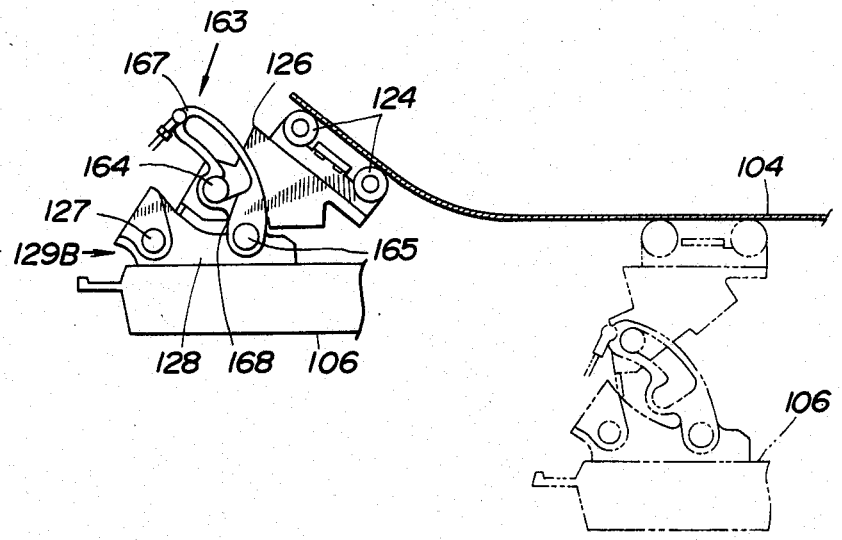
FIG. 14 is a sectional view of the upper front lock mechanism and its surroundings of FIG. 7.

As shown in FIGS. 7, 13, and 14, and upper front lock mechanism 162 is provided on the upper roller supporting mechanism 129B. This lock mechanism 163 includes a stopper pin 164 and an engagement member 167. The stopper pin 164 fixedly projects from the upper surface of the roller bracket 126. The engagement member 167 is approximately arcuate and has an end rotatably connected to the upper surface of the door arm 128 by means of a pivot 165. A spring 169 urges the engagement member 167 with respect to the door arm 128 in the direction Q of FIG. 13. One end of a wire 166 is connected to the free end of the engagement member 167. As shown in FIG. 8, the other end of the wire 166 is connected to the base of the relief lever 138 of the operation mechanism 113. When the operation mechanism 113 is actuated and the release lever 135 is rotated, the relief lever 138 is rotated and thus the wire 166 is moved. In accordance with the movement of the wire 166, the engagement member 167 is rotated. The engagement member 167 has a doglegged aperture 168, which includes a sliding segment 168A and a holding segment 168B in communication with each other. The sliding segment 168A extends approximately circumferentially with respect to the pivot 127 of the roller bracket 126. The holding segment 168B extends from an end of the sliding segment 168A in a circumferential direction with respect to the pivot 165 of the engagement member 167. The stopper pin 164 is slidably disposed in the aperture 168 so that the engagement member 167 engages the stopper pin 164.

When the stopper pin 164 fits in the holding segment 168B of the aperture 168 as shown in FIG. 13, the roller bracket 126 is fixed relative to the door arm 128 so that the bracket 126 is prevented from pivoting. As described hereinbefore, rotation of the roller bracket 126 allows the rollers 124 and 125 to move along the curved portion of the corresponding guide rail. Accordingly, under the conditions shown in FIG. 13, the combination of the rollers 124 and 125, and the roller bracket 126 cannot move along the curved portion of the corresponding guide rail, and thus the upper front lock mechanism 163 is in its locked or active position. When the operation mechanism 113 (see FIG. 8) is actuated and thus the wire 161 is moved, the stopper pin 164 moves from the holding segment 168B to the sliding segment 168A of the aperture 168. In this case, the stopper pin 164 can relatively move along the aperture sliding segment 168A so that the roller bracket 126 is able to pivot. Thus, the upper front lock mechanism 163 is in its unlocked or rest position.

Overall operation will follow. Under conditions where the sliding door 106 is in its closed position and the knob 143 is in its upper position, when the outside handle 111 or the inside handle 112 is actuated, and thus the operation mechanism 113 is activated, the second open lever 151 of the rear lock mechanism 114 releases the latch 117. At the same time, the engagement end 159*a* of the hook 159 of the lower front lock mechanism 152 is moved approximately downwards about the pivot 158 and exits from the receiving hole 156. Also, the engagement member 167 of the upper front lock mechanism 163 is rotated about the pivot 165, moving the stopper pin 164 from the holding segment 168B to the sliding segment 168A of the aperture 168. Then, as the sliding door 106 is moved rearwards from the door opening 102, the rollers 124 and 125 slide along the guide rails 103, 104, and 105. At this time, the sliding door 106 moves outwards and rearwards to a position as illustrated by the phantom lines in FIGS. 11 and 14. In this way, the sliding door 106 is opened.

As the sliding door 106 is moved frontwards into its closed position, the latch 117 of the rear lock mechanism 114 meets the striker 115 and then the second open lever 151 engages the latch 117, thereby forcing the latch 117 into firm engagement with the striker 115. At the same time, the engagement end 159*a* of the hook 159 of the lower front lock mechanism 152 slides on the section of the bracket 155 defining the receiving hole 156 and moves into the receiving hole 156, firmly engaging the bracket 155. Also, the stopper pin 164 of the upper front lock mechanism 163 moves from the sliding segment 168A to the holding segment 168B of the aperture 168. In this way, the rear lock mechanism 114, the lower front lock mechanism 152, and the upper front lock mechanism 163 locks the rear edge, the bottom of the front edge, and the top of the front edge of the sliding door 106 to the vehicle body. These lock mechanisms 114, 152, and 163 reliably bear a transverse load or force applied to the sliding door 106.

Lock by the lower front lock mechanism 152 is reliable and firm, since this lock is performed by movement of the hook 159 into the receiving hole 156. In addition, the hook 159 is subjected to a relatively weak friction during its movement out of the receiving hole 156 so that the lock can be released by a weak force. Furthermore, since the hook 159 is provided on the lower roller supporting mechanism 129C, it is unnecessary to provide another rigid structure for mounting the lower front lock mechanism 152. It should be noted that the lower roller supporting mechanism 129C and a section of the sliding door 106 holding the mechanism 129C are rigid.

Figure 15:
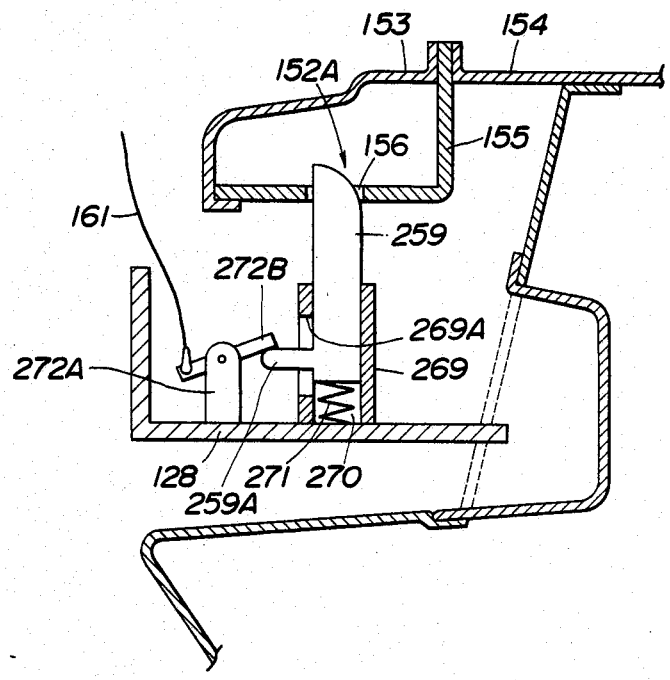
FIG. 15 is a sectional view of a modification of the lower front lock mechanism according to the third embodiment of this invention.

FIG. 15 shows a modification of the lower front lock mechanism in the embodiment of FIGS. 7 to 14. This modified lower front lock mechanism 152A includes a tubular bracket 269 and an engagement straight bar 259 slidably extending into the bracket 269. The bracket 269 is fixed to the door arm 128 of the lower roller supporting mechanism 129C. The bracket 269 has a bore 270 in which a spring 271 is disposed. When the sliding door 106 is closed, the spring 271 forces the engagement member 259 upwards into the receiving hole 156. Thus, the engagement member 259 engages the bracket 155.

A lever 272B is pivoitaly connected to a support 272A fixed to the door arm 128. The end of the wire 161 connected to the relief lever 138 (see FIG. 8) of the operation mechanism 113 is fixed to one end of the lever 272B. The bracket 269 has an axial slot 269A. The engagement member 259 has a radially-extending control arm 259A, which extends through the slot 269A and engages the other end of the lever 272B. As the operation mechanism 113 is actuated and the wire 161 is moved, the lever 272B is rotated and the engagement member 259 is displaced downwards. In accordance with this downward displacement, the engagement member 259 moves out of the receiving hole 156 and disengages from the bracket 155.

In the embodiment of FIGS. 7 to 15, the upper front lock mechanism may be designed in a manner similar to that of the lower front lock mechanism. The lower front lock mechanism may be designed in a manner similar to that of the upper front lock mechanism. One of the upper and lower front lock mechanisms may be omitted.

This invention may be applied to a sliding door-equipped automotive vehicle in which upper and lower guide rails have curved fronts but the whole of a waist guide rail is straight. Such a vehicle is shown in Japanese Utility model 52-57555 published Dec. 27, 1977, the disclosure of which is hereby incorporated by reference.

What is claimed is:

1. A lock arrangement for a sliding door to close and unblock a door opening in a side of a vehicle body, the arrangement comprising:

(a) a waist guide rail fixed to an outer surface of the vehicle body side and extending rearwards from the door opening;

(b) an upper guide rail fixed to the vehicle body and extending along an upper edge of the door opening, the upper guide rail having a front curved toward the interior of the vehicle body;

(c) a lower guide rail fixed to the vehicle body and extending along a lower edge of the door opening, the lower guide rail having a front curved toward the interior of the vehicle body;

(d) a waist roller supporting mechanism provided on a rear edge of the sliding door and including a waist roller slidably engaging the waist guide rail, a waist roller bracket on which the waist roller is rotatably supported, and a waist door arm fixed to the vehicle body, the waist roller bracket being supported on the waist door arm and rotatable in the horizontal with respect to the vehicle body;

(e) an upper roller supporting mechanism provided on a top of a front edge of the sliding door and including an upper roller slidably engaging the upper guide rail, an upper roller bracket on which the upper roller is rotatably supported, and an upper door arm fixed to the vehicle body, the upper roller bracket being supported on the upper door arm and rotatable in the horizontal with respect to the vehicle body;

(f) a lower roller supporting mechanism provided on a bottom of the front edge of the sliding door and including a lower roller slidably engaging the lower guide rail, a lower roller bracket on which the lower roller is rotatably supported, and a lower door arm fixed to the vehicle body, the lower roller bracket being supported on the lower door arm and rotatable in the horizontal with respect to the vehicle body;

(g) a roller supporting mechanisms and the guide rails being cooperative to move the sliding door outwards and rearwards from the door opening when the sliding door is opened;

(h) a handle movably supported on the sliding door;

(i) an operation mechanism supported on the sliding door and connected to the handle for action in accordance with actuation of the handle;

(j) a striker fixed to a section of the vehicle body defining a rear edge of the door opening;

(k) a latch provided on a rear edge of the sliding door and connected to the operation mechanism, the latch engaging the striker when the sliding door is closed and disengaging from the striker in response to action of the operation mechanism; and (l) a front lock apparatus releasably locking the front edge of the sliding door to the vehicle body and including a front lock mechanism releasably locking a present portion of the door front edge to the vehicle body when the sliding door is closed;

wherein the front lock mechanism includes a stopper pin provided on one of the upper and lower roller brackets, an engagement member having a hole in which the stopper pin is disposed, the engagement member engaging the stopper pin and movably supported on the door arm associated with the stopper-pin-provided roller bracket, and means for connecting the engagement member to the operation mechanism, rotation of the stopper-pin-provided roller bracket relative to the associated door arm being prevented when the door is closed, the prevention of rotation of the stopper-pin-provided roller bracket being disabled in response to action of the operation mechanism.

2. A lock arrangement for a sliding door to close and unblock a door opening in a side of a vehicle body, the arrangement comprising:

(a) a waist guide rail fixed to an outer surface of the vehicle body side and extending rearwards from the door opening;

(b) an upper guide rail fixed to the vehicle body and extending along an upper edge of the door opening, the upper guide rail having a front curved toward the interior of the vehicle body;

(c) a lower guide rail fixed to the vehicle body and extending along a lower edge of the door opening, the lower guide rail having a front curved toward the interior of the vehicle body;

(d) a waist roller supporting mechanism provided on a rear edge of the sliding door and including a waist roller slidably engaging the waist guide rail, a waist roller bracket on which the waist roller is rotatably supported, and a waist door arm fixed to the vehicle body, the waist roller bracket being supported on the waist door arm and rotatable in the horizontal with respect to the vehicle body;

(e) an upper roller supporting mechanism provided on a top of a front edge of the sliding door and including an upper roller slidably engaging the upper guide rail, an upper roller bracket on which the upper roller is rotatably supported, and an upper door arm fixed to the vehicle body, the upper roller bracket being supported on the upper door arm and rotatable in the horizontal with respect to the vehicle body;

(f) a lower roller supporting mechanism provided on a bottom of the front edge of the sliding door and including a lower roller slidably engaging the lower guide rail, a lower roller bracket on which the lower roller is rotatably supported, and a lower door arm fixed to the vehicle body, the lower roller bracket being supported on the lower door arm and rotatable in the horizontal with respect to the vehicle body;

(g) the roller supporting mechanisms and the guide rails being cooperative to move the sliding door outwards and rearwards from the door opening when the sliding door is opened;

(h) a handle movably supported on the sliding door;

(i) an operation mechanism supported on the sliding door and connected to the handle for action in accordance with actuation of the handle;

(j) a striker fixed to a section of the vehicle body defining a rear edge of the door opening;

(k) a latch provided on a rear edge of the sliding door and connected to the operation mechanism, the latch engaging the striker when the sliding door is closed and disengaging from the striker in response to action of the operation mechanism; and (l) a front lock apparatus releasably locking the front edge of the sliding door to the vehicle body and including a front lock mechanism releasably locking a present portion of the door front edge to the vehicle body when the sliding door is closed;

wherein the front lock mechanism includes a bracket fixed to the vehicle body, the bracket having a receiving hole, an engagement member movably supported on one of the upper and lower door arms and movable into and out of the receiving hole to engage with and disengage from the bracket, and means connected to both of the engagement member and the operation mechanism for displacing the engagement member into the receiving hole when the door is closed and displacing the engagement member out of the receiving hole in response to action of the operation mechanism.

3. The arrangement of claim 2, wherein the front lock mechanism further includes a tube fixed to the door arm, the engagement member slidably extending into the tube.

* * * * *